US008729447B2

(12) United States Patent
Jarron et al.

(10) Patent No.: US 8,729,447 B2
(45) Date of Patent: May 20, 2014

(54) MICROCHANNEL PLATE AND ITS MANUFACTURING METHOD

(75) Inventors: Pierre Jarron, Saint-Julien (FR); Nicolas Wyrsch, Hauterive (CH)

(73) Assignee: Ecole Polytechnique Federale de Lausanne (EPFL), Lausanne (CH)

( * ) Notice: Subject to any disclaimer, the term of this patent is extended or adjusted under 35 U.S.C. 154(b) by 370 days.

(21) Appl. No.: 13/383,001

(22) PCT Filed: Jul. 8, 2010

(86) PCT No.: PCT/EP2010/059774
§ 371 (c)(1), (2), (4) Date: Jan. 9, 2012

(87) PCT Pub. No.: WO2011/009730
PCT Pub. Date: Jan. 27, 2011

(65) Prior Publication Data

US 2012/0187278 A1 Jul. 26, 2012

(30) Foreign Application Priority Data

Jul. 21, 2009 (EP) ..... 09166019

(51) Int. Cl.
*H01J 40/14* (2006.01)
*H01J 43/00* (2006.01)

(52) U.S. Cl.
USPC ..... 250/207; 313/103 R

(58) Field of Classification Search
USPC ..... 250/207; 313/103 R, 103 CM
See application file for complete search history.

(56) References Cited

U.S. PATENT DOCUMENTS 5,359,187 A 10/1994 Weiss
5,568,013 A 10/1996 Then et al.
5,997,713 A * 12/1999 Beetz et al. ..... 205/124
6,522,061 B1 2/2003 Lockwood

FOREIGN PATENT DOCUMENTS

KR 2008 0062335 A 7/2008

OTHER PUBLICATIONS

Charles P. Beetz et al. : "Silicon-micromachined microchannel plates", Nuclear Instruments and Methods in Physics Research A, vol. 442, 2000, -2000, pp. 443-451, XP002558587, abstract p. 445.
N. Wyrsch et al.: "Vertical integration of hydrogenated amorphous silicon devices on CMOS circuits", Institut de Microtechnique, Universite de Neuchatel, Breguet 2, CH-2000 Neuchatel, Switzerland,CSEM SA, Badenerstrasse 569, P.O. Box, CH-8048 Zurich, Switzerland, CERN, CH-1211 Geneve 23, Switzerland, Mater. Res. Soc. Symp. Proc. vol. 869 © 2005 Materials Research Society.
International Search Report, dated Dec. 15, 2010, from corresponding PCT application.
European Search Report, dated Dec. 2, 2009, from corresponding European application.

* cited by examiner

*Primary Examiner* — Thanh Luu
(74) *Attorney, Agent, or Firm* — Young & Thompson

(57) ABSTRACT

A microchannel plate (1) having an array of channels (5), includes a substrate (2) and, deposited on the substrate, a hydrogenated amorphous silicon film (3) having a thickness ranging between 50 μm and 200 μm, preferably between 80 μm and 120 μm, the film including the array of channels (5). Preferably, the substrate (2) is an integrated circuit having an internal electronic readout circuit and pixilated collection electrodes (8), and the film (3) is integrated on the substrate (2). The channels (5) may be formed by a Deep Reactive Ion Etching (DRIE) process.

28 Claims, 3 Drawing Sheets

MICROCHANNEL PLATE AND ITS MANUFACTURING METHOD

TECHNICAL FIELD

The present invention relates to a microchannel plate ("MCP"), and its manufacturing method. The present invention relates also to an electron multiplier imaging device comprising such microchannel plate.

BACKGROUND OF THE INVENTION

MCP's have been firstly used in image intensifier tubes for night/low light vision applications to amplify ambient light into a useful image. A typical intensifier device is a vacuum device, with a photocathode and a microchannel plate ("MCP"), and a phosphor screen with adaptation optics. Incoming photons strike the photocathode and converts photons to electrons, which are accelerated toward the MCP by an electric field. The MCP has many microchannels, each of which functions as an independent electron amplifier. The amplified electron image of the MCP excites a phosphor screen or a CCD or any other imaging device.

Detection and amplification of low-level image signals or single photon or particle detection is a critical function in a wide variety of applications:

- High energy physics: particle detection and particle tracker systems.
- Molecular biology: observation of low-level fluorescence and luminescence in living cells, radio luminescence imaging.
- Astronomical: grazing-incidence telescopes for light and soft X-ray astronomy, concave grating spectrometers for exploration of planetary atmospheres, laser satellite ranging systems.
- Nuclear medicine: X-ray imaging, Computer Tomography (CT), Positron emission Tomography (PET)
- Commercial: night vision.

The current process used in industry for manufacturing microchannel plates is primarily based on the technology of drawing glass fibers and fiber bundles that are sliced and etched. The individual plates are polished to an optical finish. The solid cores are removed by chemical etching in an etchant that does not attack the lead oxide glass walls, thus generating hollow channels through the plates. Standard MCP is based on the manufacturing of microchannels of about 5-10 μm diameter densely arranged in a plate of lead glass of about 0.5 mm. Microchannel in lead glass are not naturally resistive, and an additional thin film of semiconducting material must be deposited on the microchannel wall, in such a way to lead to the formation of a thin, slightly conducting layer beneath the electron-emissive surface of the channel walls. Electrodes, in the form of thin metal films, are deposited on both faces of the finished wafer. The process is complex and costly.

Current manufacturing technologies for MCP with materials other than glass also are known. One of the methods invented to make MCP's with alternate material is by using materials called green sheets. Green sheets are made by first mixing polymer binder and powdered ceramic/glass. This slurry is then coated in sheet form and dried to form green sheets. In this method, such green sheets were punctured with array of holes of the sizes to MCP tubes. Subsequently, the sheets were stacked on top of each other such that the holes punctured in each sheets align thus forming array of micro tubes, the structure needed for MCP. Subsequently, this whole structure is annealed at a high temperature to make it solid.

More recent MCP based on crystalline silicon profit from recent technology improvements.

In silicon MCP's, an array of holes is etched in silicon wafer using different techniques such as electrochemical etching, reactive ion etching and streaming electron cyclotron resonance etching. However, low resistivity of bulk crystalline requires an extra oxidation film and a deposition of a semiconducting layer. Therefore, this MCP structure in the silicon wafer should be then oxidized to form $SiO_2$ for electrical insulation and it is further processed to provide a gain enhancing layer on channel walls and electrodes on both sides.

The above-described limitations of current MCP manufacturing technology must be overcome. By fusing, drawing, and etching it is impossible or prohibitively expensive to make channel diameters below 5 μm and maintain a large open area ratio. Previous generations of microchannel plates have.

There have been some alternatives to current glass MCP manufacturing technology based on GaAs and fused silica using micromachining techniques of dry etching. Etch methods used were magnetron reactive ion etching, chemically assisted ion beam etching ("CAIBE"), and electron cyclotron resonance etching ("ECR"). CAIBE gives high aspect ratio etching of GaAs, but at low etch rates. ECR provided higher etch rates of GaAs and better substrate temperature control.

Other structures of microchannel plates have been fabricated using Silicon micromachining techniques. High aspect ratio pores were constructed using reactive ion etching and streaming electron cyclotron resonance etching, and low-pressure chemical vapor deposition (LPCVD). Typical microchannels have pitch of 8 microns and depth of 350 microns.

The drawbacks of current MCP are that:

- a slow recharging time constant is associated with each microchannel after one secondary electron emission avalanche event, a dead time in the order of 10 ms, limiting gain and counting rate capability.
- besides material issues, existing MCP do not have an easy readout for finely pixilated imaging device.
- current MCP technologies do not provide the integration of the MCP device with the imaging readout system.
- current etching methods limit miniaturization of pore diameters to 5 μm.

The invention aims to avoid this disadvantage.

SUMMARY OF THE INVENTION

To this end, the present invention provides a microchannel plate having an array of channels, wherein said microchannel plate comprises a substrate and, deposited on said substrate, a hydrogenated amorphous silicon film having a thickness comprised between 50 μm and 200 μm, preferably comprised between 80 μm and 120 μm, said film comprising said array of channels.

The present invention relates also to a method for manufacturing a microchannel plate as defined above, wherein the method comprises the steps of

- preparing a substrate comprising collecting electrodes,
- depositing, on said substrate, a hydrogenated amorphous silicon layer having a thickness comprised between 50 μm and 200 μm, preferably comprised between 80 μm and 120 μm, in such a way as to form a hydrogenated amorphous silicon film,
- depositing, on said hydrogenated amorphous silicon film, a conductive or semi-conductive layer, forming a top electrode,
- forming an array of channels in said film.

The present invention relates also to an electron multiplier imaging device comprising a microchannel plate as defined above.

The present invention relates also to a method for detecting input electrons by means of a microchannel plate as defined above, wherein said method comprises the steps of:

amplifying a current signal corresponding to said input electrons, by using the array of channels of the microchannel plate, to produce an amplified current signal, and detecting said amplified current signal by using the collecting electrodes of the substrate and the electronic readout circuit of the microchannel plate.

DETAILED DESCRIPTION

Figure 1:
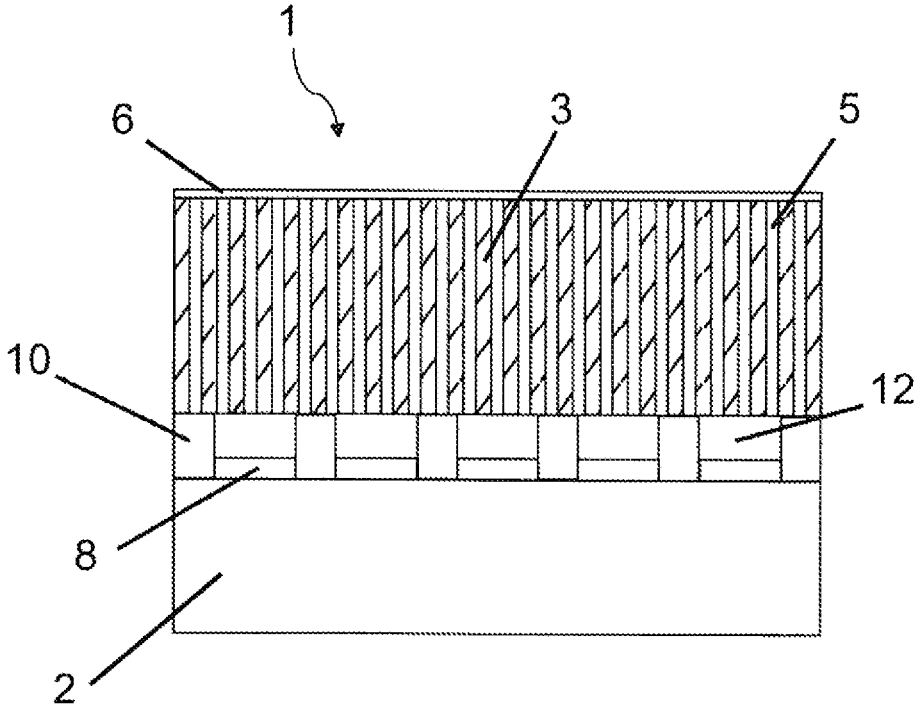
FIG. 1 is a cross section of a microchannel plate according to the present invention.

As shown in FIG. 1, the microchannel plate 1 of the invention comprises a substrate 2 and, deposited on said substrate 2, a hydrogenated amorphous silicon film 3 having a thickness comprised between 50 μm and 200 μm, preferably comprised between 80 μm and 120 μm.

The hydrogenated amorphous silicon may be intrinsic. It may be also doped or alloyed with other elements such as oxygen, nitrogen, carbon, germanium to modify its bulk resistivity Said film comprises an array of channels 5.

Advantageously, said array of channels 5 comprises holes fabricating by etching technique. Preferably, microchannels 5 are formed by the etching technique of Deep Reactive Ion Etching (DRIE), but other techniques as laser photon assisted etching or any other anisotropic patterning may be used.

Preferably, the microchannels have a diameter less than 10 μm, more preferably less than 5 μm, and more preferably comprised between 2 μm and 3 μm.

The film 3 comprises, on the top side, a top electrode 6. Said top electrode 6 can consist of any conductive or semi-conductive layer able to provide a uniform voltage distribution over the entire active area (area where the microchannels 5 are present). A metal layer or doped amorphous silicon layer are preferentially used.

Advantageously, said top electrode 6 is biased with a voltage of 500 V to 1 500 V that establishes an electric field E inside the wall of microchannels 5.

The substrate 2 is an active substrate or a passive substrate which is insulating, rigid and flat enough.

Preferably, the substrate 2 is selected from the group consisting of glass, oxidized silicon wafer, and integrated circuits comprising Very Large Scale Integration (VLSI) circuit, Application Specific Integrated circuit (ASIC) and Charge Coupled Device (CCD) circuit.

Advantageously, said substrate 2 comprises collecting electrodes 8 connected to an electronic readout circuit, said collecting electrodes 8 being designed to collect electrons packets that are generated by secondary avalanche emanating from excited microchannels 5.

Preferably, said collecting electrodes 8 define pixels.

In some embodiments, the substrate 2 is a passive substrate with a metal electrode which can be patterned to define pixel collection electrodes 8.

Such collection electrodes 8 are connected to an external readout electronic circuit.

In other embodiments, the substrate 2 is an active substrate such as an integrated circuit comprising an internal electronic readout circuit connected to the pixilated collection electrodes 8. In such a case, the active substrate 2 collects electron packets generated by multiplication in the microchannels 5 on its pixel collecting electrodes 8, and subsequently processes pixel information by the electronic readout circuit integrated in the active substrate.

Advantageously, the film 3 is integrated on said substrate 2.

The present invention relates also to a method for manufacturing a microchannel plate as described above. This method comprises the steps of:

preparing a substrate 2 comprising collecting electrodes 8, depositing, on said substrate 2, a hydrogenated amorphous silicon layer having a thickness comprised between 50 μm and 200 μm, preferably comprised between 80 μm and 120 μm, in such a way as to form a hydrogenated amorphous silicon film 3, depositing, on said hydrogenated amorphous silicon film 3, a conductive or semi-conductive layer, forming a top electrode 6, forming an array of channels 5 in said film 3.

The method further comprises a step of patterning the collecting electrodes 8 to define pixels.

The substrate 2 comprises a passivation layer 10 (having for example a thickness of 5 μm), which comprises holes 12 in which the collecting electrodes 8 are formed. The holes 12 in passivation layer 10 are advantageously formed during the fabrication of the active substrate 2.

Preferably, the hydrogenated amorphous silicon layer is deposited by a Chemical Vapor Deposition (CVD) process. The use of PE-CVD using VHF excitation frequency is preferred for its ability to control the mechanical stress in the layer (see N. Wyrsch et al., MRS Symp. Proc. Vol. 869 (2005) 3-14).

The method of the invention may further comprise a step of depositing an additional layer (such as silicon nitride or silicon oxide), which can be conveniently inserted between the substrate 2 and the hydrogenated amorphous silicon layer to act as etch stopping layer in order to better control the DRIE process for the microchannel formation.

Then, the top electrode 6 is formed on the top side of the hydrogenated amorphous silicon film 3. Doping of the top of the amorphous silicon by implantation, deposition of doped amorphous silicon based layer or deposition of any type of conducting layer are possible option for this top conducting electrode.

Then the method of the invention further comprises the step of forming a mask on top of the layer stack for the microchannel etching process by patterning a photoresist layer and, when used, additional patterning the underlying top electrode 6. Advantageously, said patterning of the top electrode 6 is not necessary in case of a semiconducting electrode.

Then, the microchannels 5 are drilled into the film 3. Advantageously, the channels are formed by a Deep Reactive Ion Etching (DRIE) process. This anisotropic etching provides high precision micromachining of microchannels.

The method of the invention has the advantage to offer a good and uniform etching stable electric field gradient in microchannel wall thanks to the high resistivity of the intrinsic amorphous silicon film, about $10^{12}$ ohm.cm. There is no need to isolate bulk by an oxide and a semiconductor film like in crystalline silicon MCP, or to add a semiconductor film like for the fabrication of MCP based on lead glass substrate.

As the charge (electrons) moving in the microchannels are already inducing the charge creation on the pixel collecting electrode and there is no need to have a direct connection between the microchannel and the pixel collecting electrode. A thin layer of the bulk material (amorphous hydrogenated silicon or an alloy based on this material) can remain.

The present invention relates also to an electron multiplier imaging device comprising a microchannel plate as described above.

The present invention relates also to a method for detecting input electrons by means of a microchannel plate as described above, said method comprising the steps of:

amplifying a current signal corresponding to said input electrons, by using the array of channels 5 of the microchannel plate 1, to produce an amplified current signal, and detecting said amplified current signal by using the collecting electrodes 8 of the substrate 2 and the electronic readout circuit of the microchannel plate 1.

Figure 2:
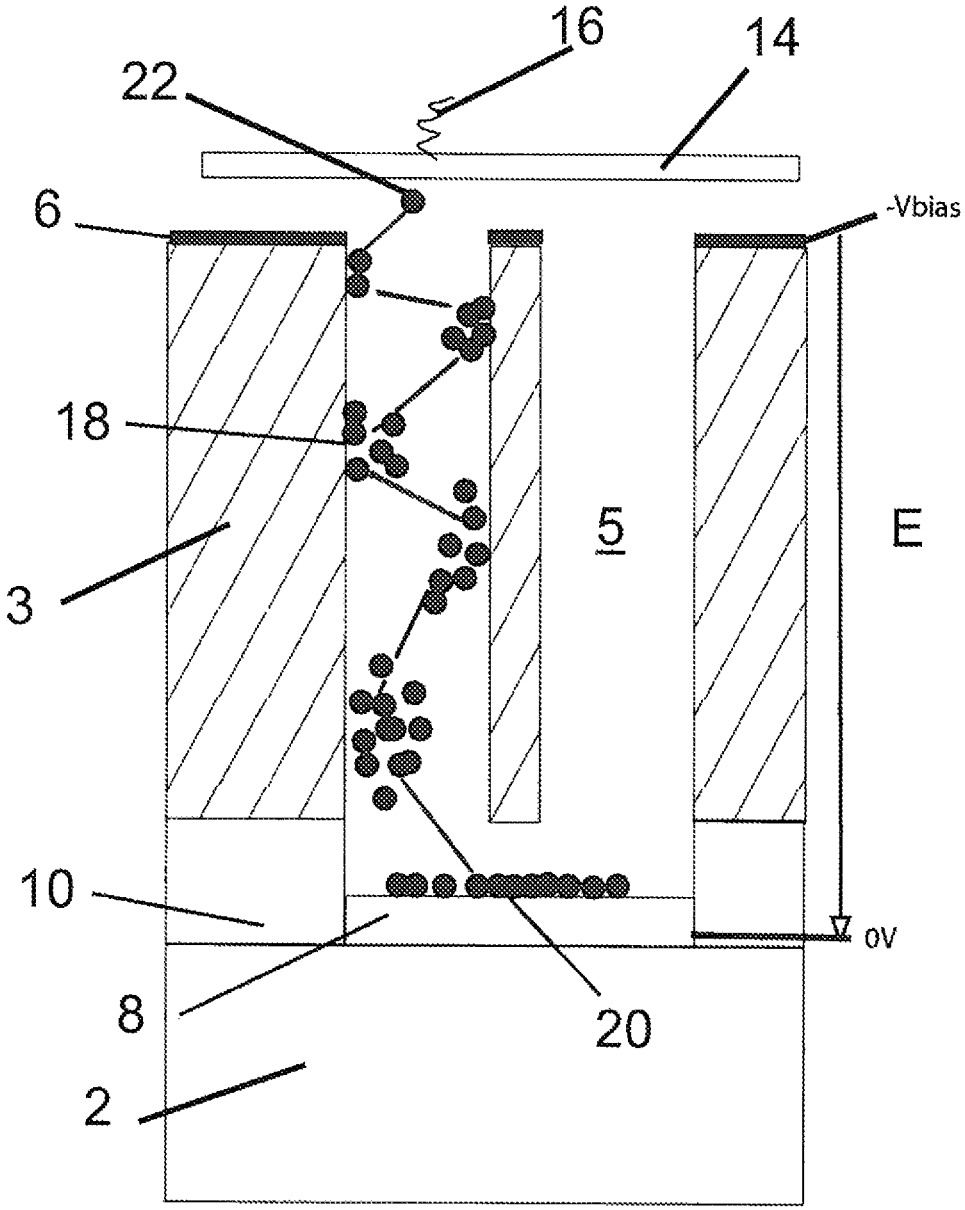
FIG. 2 is a schematic view showing the principle of an electron multiplier imaging device comprising a microchannel plate of the invention.

As shown in FIG. 2, the electron multiplier imaging device comprises the microchannel plate of the invention, and a photo-cathode or an ionization converter 14.

Electron multiplication is based on secondary electron emission as any other microchannel plate or photo multiplier devices. An electric field E is applied to the hydrogenated amorphous silicon thick film 3 between the pixel collecting electrodes 8 and the top electrode 6. For the device placed in vacuum, when one primary electron 22 coming from the photocathode 14 (said primary electron 22 created by the conversion of photon or charge particle 16 impinging on said photocathode 14) or other single electron source enters in one microchannel 5, a cascade of secondary electrons 18 is produced along the microchannel 5 by secondary electron emission resulting in an electron multiplication along the microchannel 5 that eventually formed a large packet of electrons 20 that is collected by the pixel collecting electrode 8 in front of the excited microchannel 5.

Bulk resistivity of hydrogenated amorphous silicon material, especially intrinsic hydrogenated amorphous silicon, enables operation at high counting rate of microchannel plate without special post processing treatment of microchannel wall, in contrast with standard microchannel plates made in insulating lead glass. Recharging time constant of microchannel will be order of magnitudes faster enabling high counting rated operation without distortions of the internal electric field of microchannel caused by positive charging of its wall.

The high resistivity of intrinsic hydrogenated amorphous silicon of $10^{12}$ ohm.cm minimizes leakage current of the microchannel plate under bias, 1 KV applied to 100 μm thick film exhibits a leakage current of 100 nA whereas silicon crystal that is too conductor to achieve low enough leakage current.

In a preferred embodiment, the substrate is a pixel integrated circuit comprising an internal electronic readout circuit and pixilated collection electrodes and the hydrogenated amorphous silicon layer is integrated on said substrate The electric property of the amorphous silicon bulk provides a direct means to control the electric field gradient in the microchannel. The deposition on an integrated circuit offers the advantage to fully integrate the active substrate with the microchannel electron multiplier structure.

The microchannel plate of the invention allows to solve three key issues of MCP fabrication:

the integration of the microchannel plate device with the readout pixel imager by integrating the electron multiplier microchannel plate with VLSI integrated circuits the dead time by the virtue of the fast recharging through the bulk resistivity of the hydrogenated amorphous silicon film to simplify the fabrication of microchannels and miniaturize them by using the DRIE standard etching technique.

EXAMPLE

A microchannel plate of the invention was obtained by using, as passive substrate, an oxidized silicon wafer with pixel collecting electrodes. An intrinsic hydrogenated amorphous silicon film was deposited on said substrate by PECVD, with a thickness of 100 μm. An array of microchannels was formed by DRIE, the channels having a diameter of 3 μm.

Figure 3:
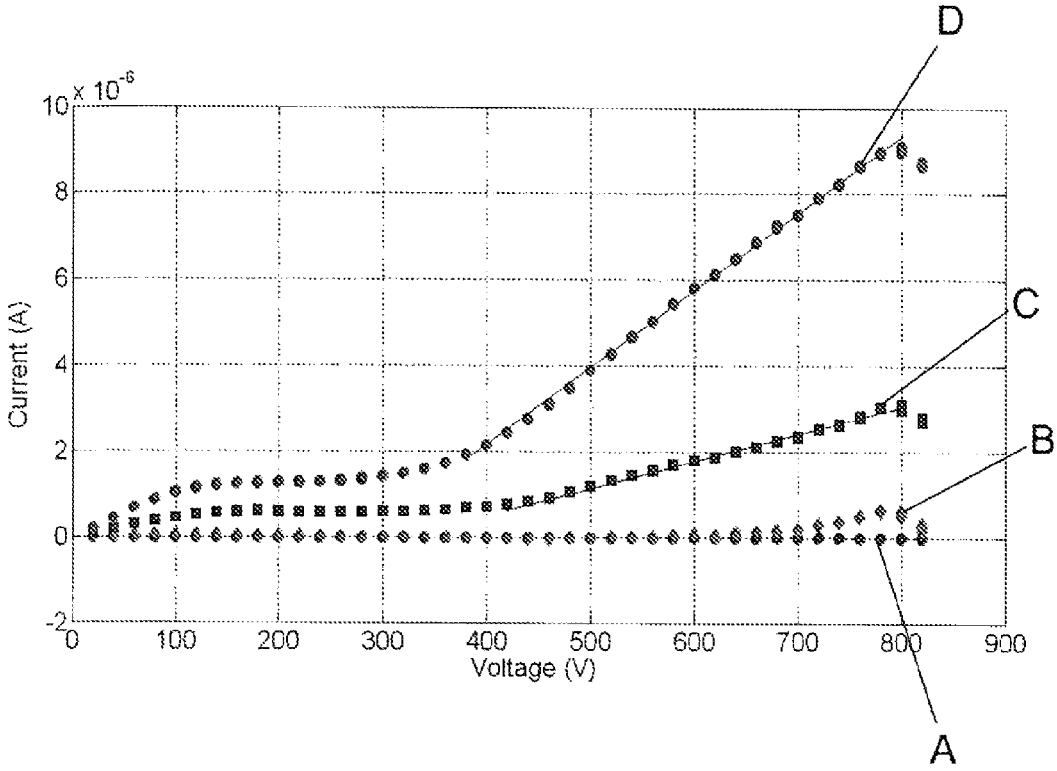
FIG. 3 represents the current measured on a microchannel pixel of the invention as a function of the MCP bias voltage and beam intensity for an electron beam focused on the sample.

The current was measured on a microchannel plate pixel as a function of the microchannel plate bias voltage and beam intensity for an electron beam focused on the sample. The results are shown in FIG. 3. The curve A corresponds to no beam, the curve B corresponds to a beam of 1.06 A, the curve C corresponds to a beam of 1.31 A, and the curve D corresponds to a beam of 1.56 A. Increase in the bias voltage enhanced the response of the microchannel plate (amplification of the incoming electron beams).

The invention claimed is:

1. Microchannel plate having an array of channels, wherein said microchannel plate comprises a substrate and, deposited on said substrate, a hydrogenated amorphous silicon film having a thickness comprised between 50 μm and 200 μm, preferably comprised between 80 μm and 120 μm, said film comprising said array of channels.

2. Microchannel plate according to claim 1, wherein said array of channels comprises holes fabricating by etching technique.

3. Microchannel plate according to claim 1, wherein said film comprises, on the top side, a top electrode.

4. Microchannel plate according to claim 2, wherein said film comprises, on the top side, a top electrode.

5. Microchannel plate according to claim 3, wherein said top electrode is biased with a voltage of 500 V to 1 500 V that establishes an electric field inside the wall of microchannels.

6. Microchannel plate according to claim 4, wherein said top electrode is biased with a voltage of 500 V to 1 500 V that establishes an electric field inside the wall of microchannels.

7. Microchannel plate according to claim 1, wherein said substrate is selected from the group consisting of glass, oxidized silicon wafer, and integrated circuits comprising Very Large Scale Integration (VLSI) circuit, Application Specific Integrated circuit (ASIC) and Charge Coupled Device (CCD) circuit.

8. Microchannel plate according to claim 2, wherein said substrate is selected from the group consisting of glass, oxidized silicon wafer, and integrated circuits comprising Very Large Scale Integration (VLSI) circuit, Application Specific Integrated circuit (ASIC) and Charge Coupled Device (CCD) circuit.

9. Microchannel plate according to claim 3, wherein said substrate is selected from the group consisting of glass, oxidized silicon wafer, and integrated circuits comprising Very Large Scale Integration (VLSI) circuit, Application Specific Integrated circuit (ASIC) and Charge Coupled Device (CCD) circuit.

10. Microchannel plate according to claim 1, wherein said substrate comprises collecting electrodes connected to an electronic readout circuit, said collecting electrodes being designed to collect electrons packets that are generated by secondary avalanche emanating from excited microchannels.

11. Microchannel plate according to claim 2, wherein said substrate comprises collecting electrodes connected to an electronic readout circuit, said collecting electrodes being designed to collect electrons packets that are generated by secondary avalanche emanating from excited microchannels.

12. Microchannel plate according to claim 3, wherein said substrate comprises collecting electrodes connected to an electronic readout circuit, said collecting electrodes being designed to collect electrons packets that are generated by secondary avalanche emanating from excited microchannels.

13. Microchannel plate according to claim 10, wherein said collecting electrodes define pixels.

14. Microchannel plate according to claim 11, wherein said collecting electrodes define pixels.

15. Microchannel plate according to claim 12, wherein said collecting electrodes define pixels.

16. Microchannel plate according to claim 13, wherein the substrate is an integrated circuit comprising an internal electronic readout circuit and pixilated collection electrodes, and wherein said film is integrated on said substrate.

17. Microchannel plate according to claim 14, wherein the substrate is an integrated circuit comprising an internal electronic readout circuit and pixilated collection electrodes, and wherein said film is integrated on said substrate.

18. Microchannel plate according to claim 15, wherein the substrate is an integrated circuit comprising an internal electronic readout circuit and pixilated collection electrodes, and wherein said film is integrated on said substrate.

19. Method for manufacturing a microchannel plate having an array of channels, said microchannel plate comprising a substrate and, deposited on said substrate, a hydrogenated amorphous silicon film having a thickness comprised between 50 μm and 200 μm, preferably comprised between 80 μm and 120 μm, said film comprising said array of channels, wherein the method comprises the steps of preparing a substrate comprising collecting electrodes, depositing, on said substrate, a hydrogenated amorphous silicon layer having a thickness comprised between 50 and 200 μm, preferably comprised between 80 and 120 μm, in such a way as to form a hydrogenated amorphous silicon film, depositing, on said hydrogenated amorphous silicon film, a conductive or semi-conductive layer, forming a top electrode, forming an array of channels in said film.

20. Method according to claim 19, wherein the hydrogenated amorphous silicon layer is deposited by a Chemical Vapor Deposition (CVD) process.

21. Method according to claim 19, wherein the channels are formed by a Deep Reactive Ion Etching (DRIE) process.

22. Method according to claim 20, wherein the channels are formed by a Deep Reactive Ion Etching (DRIE) process.

23. Method according to claim 19, wherein it further comprises a step of depositing an additional layer between the substrate and the hydrogenated amorphous silicon layer to act as etch stopping layer.

24. Method according to claim 19, wherein it further comprises a step of patterning the collecting electrodes to define pixels.

25. Method according to claim 23, wherein it further comprises a step of patterning the collecting electrodes to define pixels.

26. Electron multiplier imaging device comprising a microchannel plate having an array of channels, said microchannel plate comprising a substrate and, deposited on said substrate, a hydrogenated amorphous silicon film having a thickness comprised between 50 μm and 200 μm, preferably comprised between 80 μm and 120 μm, said film comprising said array of channels.

27. Method for detecting input electrons by means of a microchannel plate having an array of channels, said microchannel plate comprising a substrate and, deposited on said substrate, a hydrogenated amorphous silicon film having a thickness comprised between 50 μm and 200 μm, preferably comprised between 80 μm and 120 μm, said film comprising said array of channels, wherein said method comprises the steps of:

amplifying a current signal corresponding to said input electrons, by using the array of channels of said microchannel plate, to produce an amplified current signal, and detecting said amplified current signal by using the collecting electrodes of the substrate and the electronic readout circuit of said microchannel plate.

28. Method according to claim 27, wherein the substrate is an integrated circuit comprising an internal electronic readout circuit and pixilated collection electrodes and wherein the film is integrated on said substrate.

* * * * *